US011542755B2

(12) United States Patent
Duffy et al.

(10) Patent No.: US 11,542,755 B2
(45) Date of Patent: Jan. 3, 2023

(54) EARTH BORING TOOLS HAVING PROTRUSIONS TRAILING CUTTING ELEMENTS AND RELATED METHODS

(71) Applicant: Baker Hughes Oilfield Operations LLC, Houston, TX (US)

(72) Inventors: Stephen Duffy, Spring, TX (US); Scott E. Mayer, Magnolia, TX (US); Steven Craig Russell, Sugar Land, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 99 days.

(21) Appl. No.: 16/565,025

(22) Filed: Sep. 9, 2019

(65) Prior Publication Data

US 2020/0087990 A1 Mar. 19, 2020

Related U.S. Application Data

(60) Provisional application No. 62/731,484, filed on Sep. 14, 2018.

(51) Int. Cl.
*E21B 10/43* (2006.01)
*E21B 10/55* (2006.01)

(52) U.S. Cl.
CPC ..... *E21B 10/43* (2013.01); *E21B 10/55* (2013.01)

(58) Field of Classification Search
CPC ..... E21B 10/43; E21B 10/55
See application file for complete search history.

(56) References Cited

U.S. PATENT DOCUMENTS

| | | | | |
|---|---|---|---|---|
| 6,298,930 | B1 | 10/2001 | Sinor et al. | |
| 6,460,631 | B2 | 10/2002 | Dykstra et al. | |
| 6,568,492 | B2 | 5/2003 | Thigpen et al. | |
| 6,659,199 | B2 | 12/2003 | Swadi | |
| 6,779,613 | B2 | 8/2004 | Dykstra | |
| 6,935,441 | B2 | 8/2005 | Dykstra et al. | |
| 7,096,978 | B2 | 8/2006 | Dykstra et al. | |
| 7,360,608 | B2 | 4/2008 | Brackin et al. | |
| 2002/0121393 | A1* | 9/2002 | Thigpen | E21B 12/04 175/431 |
| 2003/0037964 | A1* | 2/2003 | Sinor | E21B 10/55 175/57 |
| 2012/0125687 | A1* | 5/2012 | Rives | E21B 10/36 175/57 |

* cited by examiner

*Primary Examiner* — Dany E Akakpo
(74) *Attorney, Agent, or Firm* — TraskBritt

(57) ABSTRACT

An earth-boring tool includes a body having a plurality of blades. Each blade of the plurality of blades extends axially and radially relative to a center longitudinal axis of the body. The earth-boring tool further includes a plurality of cutting elements secured within the plurality of blades and at least one protrusion trailing at least one cutting element of the plurality of cutting elements in a direction of intended rotation of the earth-boring tool and extending along a lateral side of a blade of the plurality of blades in which the at least one cutting element is secured. The earth-boring tool may further include a pocket extending into the at least one blade from a rotationally leading face of the at least one blade in at least a shoulder region of the at least one blade.

20 Claims, 11 Drawing Sheets

EARTH BORING TOOLS HAVING PROTRUSIONS TRAILING CUTTING ELEMENTS AND RELATED METHODS

CROSS-REFERENCE TO RELATED APPLICATION

This application claims the benefit under 35 U.S.C. § 119(e) of U.S. Provisional Patent Application Ser. No. 62/731,484, filed Sep. 14, 2018, the disclosure of which is hereby incorporated herein in its entirety by this reference.

TECHNICAL FIELD

This disclosure relates generally to earth-boring tools having protrusion features trailing cutting elements within one or more blades of the earth-boring tools.

BACKGROUND

Oil wells (wellbores) are usually drilled with a drill string. The drill string includes a tubular member having a drilling assembly that includes a single drill bit at its bottom end. The drilling assembly may also include devices and sensors that provide information relating to a variety of parameters relating to the drilling operations ("drilling parameters"), behavior of the drilling assembly ("drilling assembly parameters") and parameters relating to the formations penetrated by the wellbore ("formation parameters"). A drill bit and\or reamer attached to the bottom end of the drilling assembly is rotated by rotating the drill string from the drilling rig and/or by a drilling motor (also referred to as a "mud motor") in the bottom hole assembly ("BHA") to remove formation material to drill the wellbore.

BRIEF SUMMARY

Some embodiments of the present disclosure include an earth-boring tool. The earth-boring tool may include a body including a plurality of blades, each blade of the plurality of blades extending axially and radially relative to a center longitudinal axis of the body. The earth-boring tool may further include a plurality of cutting elements secured within the plurality of blades and at least one protrusion trailing at least one cutting element of the plurality of cutting elements in a direction of intended rotation of the earth-boring tool and extending along a lateral side of a blade of the plurality of blades in which the at least one cutting element is secured, wherein the at least one protrusion extends around an outer lateral side surface of the cutting element to at least substantially a same angular position about a center longitudinal axis of the earth-boring tool as a cutting table of the at least one cutting element.

In additional embodiments, the earth-boring tool may include a body including a plurality of blades, each blade of the plurality of blades extending axially and radially relative to a center longitudinal axis of the body, at least one blade of the plurality of blades having a pocket extending into the at least one blade from a rotationally leading face of the at least one blade in at least a shoulder region of the at least one blade. The earth-boring tools may also include a first plurality of cutting elements secured along rotationally leading faces of the plurality of blades and a second plurality of cutting elements secured to the at least one blade of the plurality of blades proximate a back surface of the at least one pocket, and at least one protrusion trailing at least one cutting element of the second plurality of cutting elements in a direction of intended rotation of the earth-boring tool and extending along a lateral side of the at least one blade of the plurality of blades in which the at least one cutting element is secured.

Some embodiments of the present disclosure include a method of forming an earth-boring tool. The method may include forming a body of an earth-boring tool including a plurality of blades and at least one protrusion extending across at least a portion of a lateral side of at least one blade of the plurality of blades, securing a plurality of cutting elements with the plurality of blades, and securing at least one cutting element proximate the at least one protrusion such that the at least one protrusion trails the at least one cutting element in a direction of intended rotation of the earth-boring tool.

BRIEF DESCRIPTION OF THE DRAWINGS

For a detailed understanding of the present disclosure, reference should be made to the following detailed description, taken in conjunction with the accompanying drawings, in which like elements have generally been designated with like numerals, and wherein.

DETAILED DESCRIPTION

Figure 1:
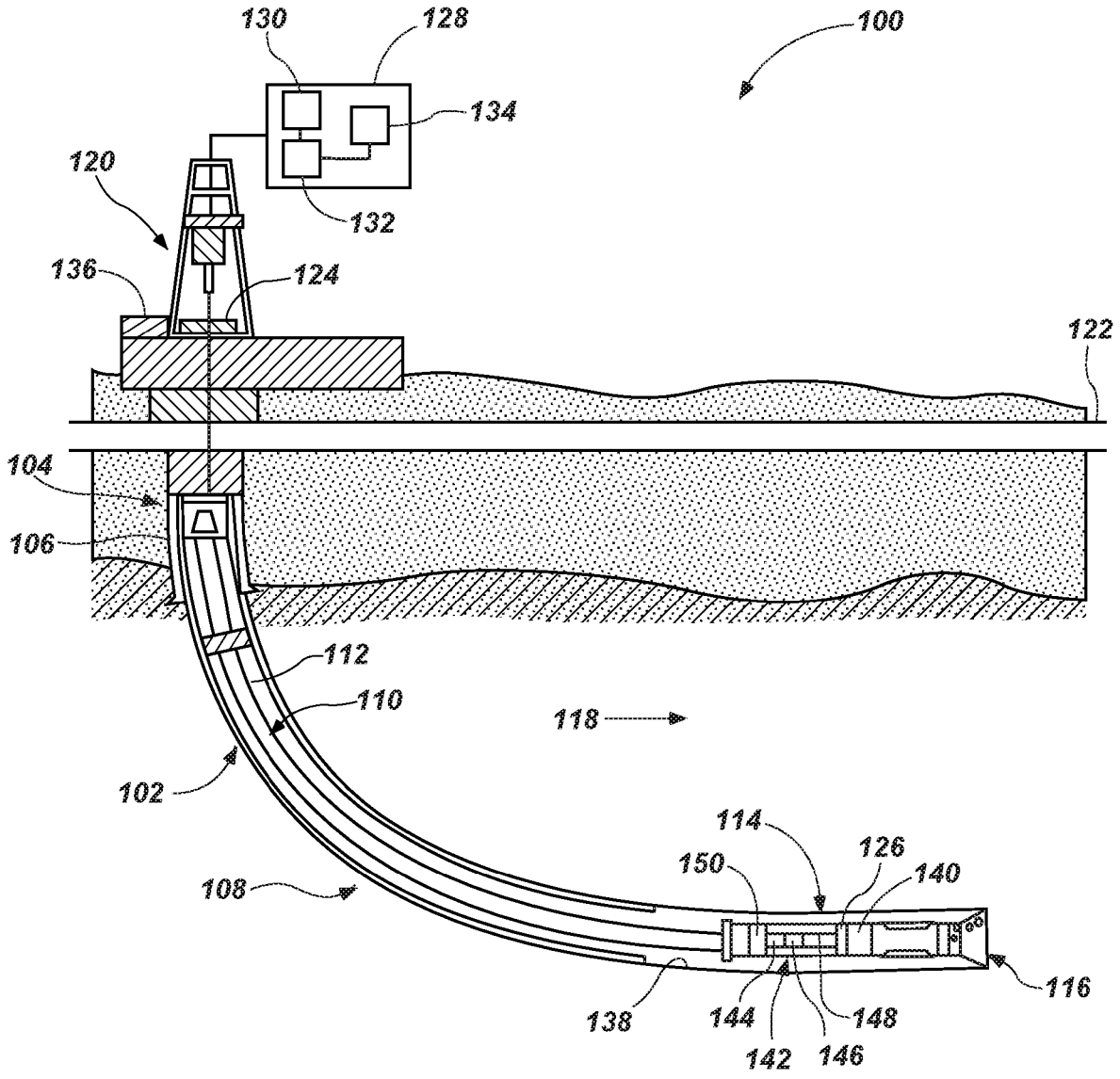
FIG. 1 is a schematic diagram of a wellbore system comprising a drill string that includes an earth-boring tool according to one or more embodiments of the present disclosure.

The illustrations presented herein are not actual views of any drill bit or any component thereof, but are merely idealized representations, which are employed to describe embodiments of the present invention.

As used herein, the terms "earth-boring tool" means and includes earth-boring tools for forming, enlarging, or forming and enlarging a borehole. Non-limiting examples of earth-boring tools include fixed cutter (drag) bits, fixed cutter coring bits, fixed cutter eccentric bits, fixed cutter bi-center bits, fixed cutter reamers, expandable reamers with blades bearing fixed cutters, and hybrid bits including both fixed cutters and rotatable cutting structures (e.g., roller cones).

As used herein, the term "cutting elements" means and includes, for example, superabrasive (e.g., polycrystalline diamond compact or "PDC") cutting elements employed as fixed cutting elements, as well as tungsten carbide inserts and superabrasive inserts employed as cutting elements mounted to a body of an earth-boring tool.

As used herein, the singular forms following "a," "an," and "the" are intended to include the plural forms as well, unless the context clearly indicates otherwise.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, any relational term, such as "first," "second," "top," "bottom," "upper," "lower," etc., is used for clarity and convenience in understanding the disclosure and accompanying drawings, and does not connote or depend on any specific preference or order, except where the context clearly indicates otherwise. For example, these terms may refer to an orientation of elements of an earth-boring tool when disposed within a borehole in a conventional manner. Furthermore, these terms may refer to an orientation of elements of an earth-boring tool when as illustrated in the drawings.

As used herein, the term "substantially" in reference to a given parameter, property, or condition means and includes to a degree that one skilled in the art would understand that the given parameter, property, or condition is met with a small degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter, as well as variations resulting from manufacturing tolerances, etc.).

As used herein, the term "cutting profile" refers to a two-dimensional representation of the profile of the cutting elements of the earth-boring tool that is defined by rotating all cutting elements of the earth-boring tool about a central longitudinal axis of the earth-boring tool and into a common plane on one half of the body of the tool.

As used herein, the term "cutting profile height" refers to an axial length (e.g., a length along an axial length of the earth-boring tool) between a bottom of a nose region of the body of the earth-boring tool and a bottom of a gage region (i.e., an interface of a shoulder region and the gage region) of the blade.

FIG. 1 is a schematic diagram of an example of a drilling system 100 that may utilize the apparatuses and methods disclosed herein for drilling boreholes. FIG. 1 shows a borehole 102 that includes an upper section 104 with a casing 106 installed therein and a lower section 108 that is being drilled with a drill string 110. The drill string 110 may include a tubular member 112 that carries a drilling assembly 114 at its bottom end. The tubular member 112 may be made up by joining drill pipe sections or it may be a string of coiled tubing, for example. A drill bit 116 may be attached to the bottom end of the drilling assembly 114 for drilling the borehole 102 of a selected diameter in a formation 118.

The drill string 110 may extend to a rig 120 at surface 122. The rig 120 shown is a land rig 120 for ease of explanation. However, the apparatuses and methods disclosed equally apply when an offshore rig 120 is used for drilling boreholes under water. A rotary table 124 or a top drive may be coupled to the drill string 110 and may be utilized to rotate the drill string 110 and to rotate the drilling assembly 114, and thus the drill bit 116 to drill the borehole 102. A drilling motor 126 may be provided in the drilling assembly 114 to rotate the drill bit 116. The drilling motor 126 may be used alone to rotate the drill bit 116 or to superimpose the rotation of the drill bit 116 by the drill string 110. The rig 120 may also include conventional equipment, such as a mechanism to add additional sections to the tubular member 112 as the borehole 102 is drilled. A surface control unit 128, which may be a computer-based unit, may be placed at the surface 122 for receiving and processing downhole data transmitted by sensors 140 in the drill bit 116 and sensors 140 in the drilling assembly 114, and for controlling selected operations of the various devices and sensors 140 in the drilling assembly 114. The sensors 140 may include one or more of sensors 140 that determine acceleration, weight on bit, torque, pressure, cutting element positions, rate of penetration, inclination, azimuth formation/lithology, etc. In some embodiments, the surface control unit 128 may include a processor 130 and a data storage device 132 (or a computer-readable medium) for storing data, algorithms, and computer programs 134. The data storage device 132 may be any suitable device, including, but not limited to, a read-only memory (ROM), a random-access memory (RAM), a flash memory, a magnetic tape, a hard disk, and an optical disk. During drilling, a drilling fluid from a source 136 thereof may be pumped under pressure through the tubular member 112, which discharges at the bottom of the drill bit 116 and returns to the surface 122 via an annular space (also referred as the "annulus") between the drill string 110 and an inside sidewall 138 of the borehole 102.

The drilling assembly 114 may further include one or more downhole sensors 140 (collectively designated by numeral 140). The sensors 140 may include any number and type of sensors 140, including, but not limited to, sensors generally known as the measurement-while-drilling (MWD) sensors or the logging-while-drilling (LWD) sensors, and sensors 140 that provide information relating to the behavior of the drilling assembly 114, such as drill bit rotation (revolutions per minute or "RPM"), tool face, pressure, vibration, whirl, bending, and stick-slip. The drilling assembly 114 may further include a controller unit 142 that controls the operation of one or more devices and sensors 140 in the drilling assembly 114. For example, the controller unit 142 may be disposed within the drill bit 116 (e.g., within a shank 208 and/or crown 210 of a bit body of the drill bit 116). The controller unit 142 may include, among other things, circuits to process the signals from sensor 140, a processor 144 (such as a microprocessor) to process the digitized signals, a data storage device 146 (such as a solid-state-memory), and a computer program 148. The processor 144 may process the digitized signals, and control downhole devices and sensors 140, and communicate data information with the surface control unit 128 via a two-way telemetry unit 150.

Figure 2A:
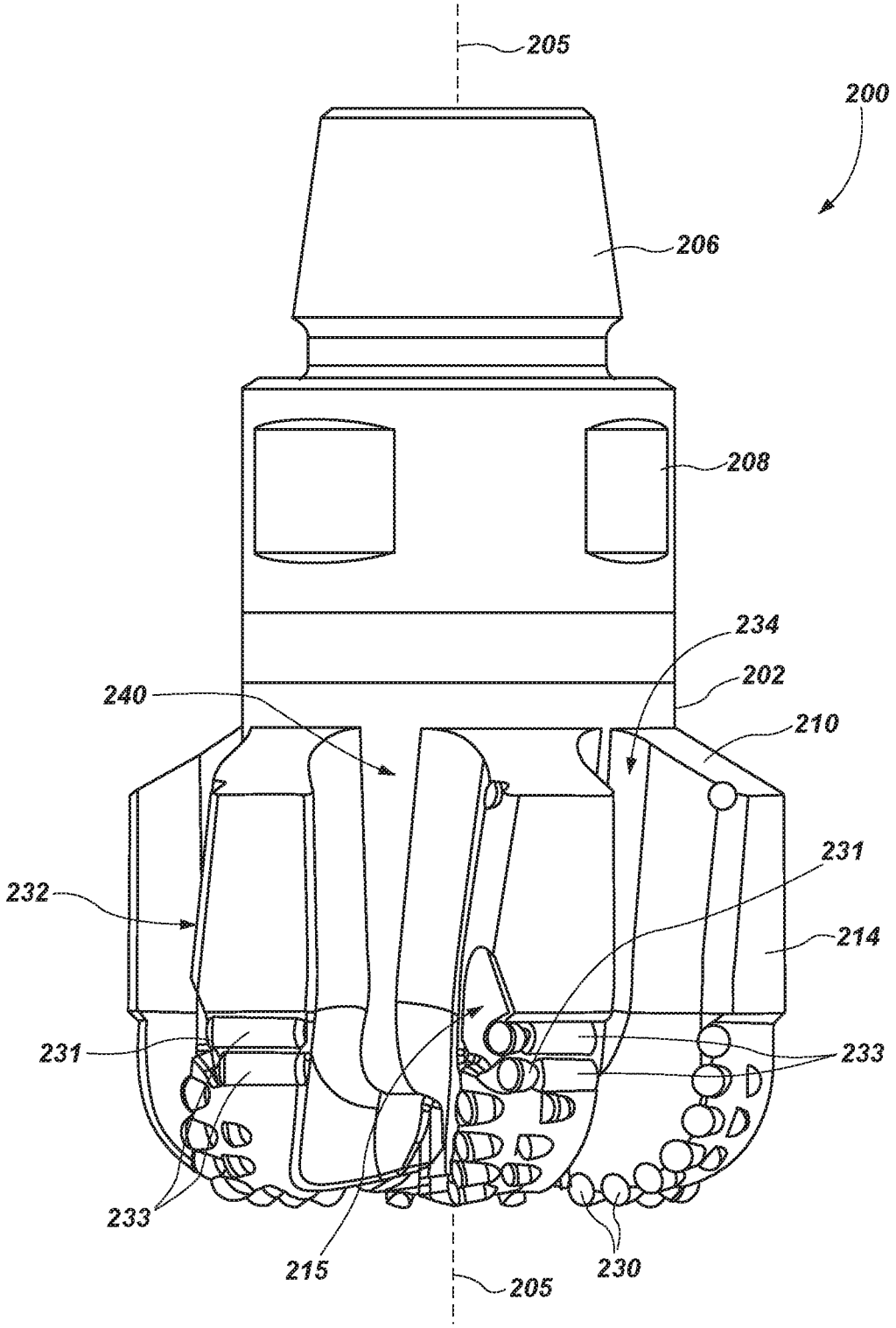
FIG. 2A is a side perspective view of an earth-boring tool according to one or more embodiments of the present disclosure.
Figure 2B:
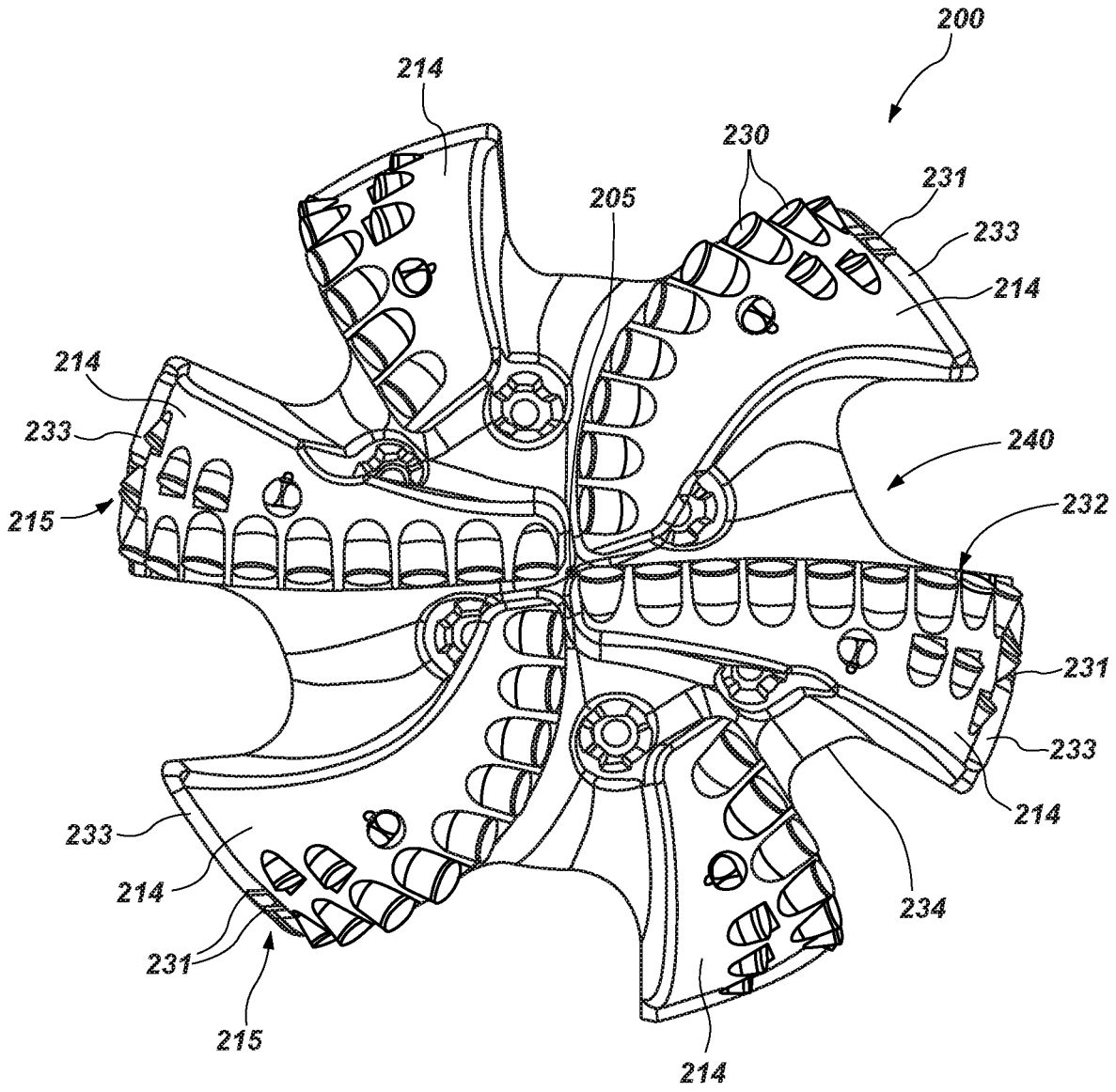
FIG. 2B is a bottom view of an earth-boring tool according to one or more embodiments of the present disclosure.

FIG. 2A is a side view of an earth-boring tool 200 that may be used with the drilling assembly 114 of FIG. 1 according to one or more embodiments of the present disclosure. FIG. 2B is a bottom view of the earth-boring tool 200 of FIG. 2A. Referring to FIGS. 2A and 2B together, in some embodiments, the earth-boring tool 200 may include a drill bit having a plurality of blades. In additional embodiments the earth-boring tool 200 may include a drill bit having at least one rotatable cutting structure in the form of a roller cone and a plurality of blades. For example, the earth-boring tool 200 may be a hybrid bit (e.g., a drill bit having both roller cones and blades). Furthermore, the earth-boring tool 200 may include any other suitable drill bit or earth-boring tool 200 having rotatable cutting structures and/or blades for use in drilling and/or enlarging a borehole 102 in a formation 118 (FIG. 1).

The earth-boring tool 200 may comprise a body 202 including a neck 206, a shank 208, and a crown 210. In some embodiments, the bulk of the body 202 may be constructed of steel, or of a ceramic-metal composite material including particles of hard material (e.g., tungsten carbide) cemented within a metal matrix material. The body 202 of the earth-boring tool 200 may have an axial center defining a center longitudinal axis 205 that may generally coincide with a rotational axis of the earth-boring tool 200. The center longitudinal axis 205 of the body 202 may extend in a direction hereinafter referred to as an "axial direction."

The body 202 may be connectable to a drill string 110 (FIG. 1). For example, the neck 206 of the body 202 may have a tapered upper end having threads thereon for connecting the earth-boring tool 200 to a box end of a drilling assembly 114 (FIG. 1). The shank 208 may include a lower straight section that is fixedly connected to the crown 210 at a joint. In some embodiments, the crown 210 may include a plurality of blades 214.

Each blade 214 of the plurality of blades 214 of the earth-boring tool 200 may include a first plurality of cutting elements 230 fixed thereto. The plurality of cutting elements 230 of each blade 214 may be located in a row along a profile of the blade 214 proximate a rotationally leading face 232 of the blade 214. In some embodiments, the first plurality of cutting elements 230 of the plurality of blades 214 may include PDC cutting elements 230. Moreover, the first plurality of cutting elements 230 of the plurality of blades 214 may include any suitable cutting element configurations and materials for drilling and/or enlarging boreholes.

The plurality of blades 214 may extend from the end of the body 202 opposite the neck 206 and may extend in both the axial and radial directions. Each blade 214 may have multiple profile regions as known in the art (i.e., a cone region, a nose region, a shoulder region, and a gage region).

Fluid courses 234 may be formed between adjacent blades 214 of the plurality of blades 214 and may be provided with drilling fluid by ports located at the end of passages leading from an internal fluid plenum extending through the body 202 from a tubular shank 208 at the upper end of the earth-boring tool 200. Nozzles may be secured within the ports for enhancing direction of fluid flow and controlling flow rate of the drilling fluid. The fluid courses 234 extend to junk slots 240 extending axially along the longitudinal side of earth-boring tool 200 between blades 214 of the plurality of blades 214.

As is discussed in greater detail below in regard to FIG. 3A, in some embodiments, at least one blade of the plurality of blades 214 may include a pocket 215 formed in the at least one blade within at least a shoulder region of the at least one blade. Furthermore, the pocket 215 may house a second plurality of cutting elements 231. Furthermore, in one or more embodiments, one or more cutting elements of the second plurality of cutting elements 231 may trail (e.g., trail in a rotational direction of the earth-boring tool) one or more cutting elements of the first plurality of cutting element 230 disposed at the rotationally leading face 232 of the blade 214. For instance, within a cutting profile of the earth-boring tool 200 defined by the first plurality of cutting elements 230 disposed at the rotationally leading face 232 of the blade 214 and the second plurality of cutting elements 231 housed by the pocket 215 formed in the at least one blade, at least one cutting element 231 of the second plurality of cutting elements 231 may at least partially overlap with a cutting element of the first plurality of cutting elements 230 of the at least one blade 214. For example, in some embodiments, between about 60% and about 100% of a single cutter profile of the at least one cutting element 231 of the second plurality of cutting elements 231 may overlap with a cutter profile of a cutting element of the first plurality of cutting elements 230 of the at least one blade 214. In some embodiments, between about 80% and about 100% of a single cutter profile of the at least one cutting element 231 of the second plurality of cutting elements 231 may overlap with a cutter profile of a cutting element of the first plurality of cutting elements 230 of the at least one blade 214. In further embodiments, between about 90% and about 100% of a single cutter profile of the at least one cutting element 231 of the second plurality of cutting elements 231 may overlap with a cutter profile of a cutting element of the first plurality of cutting elements 230 of the at least one blade 214. In yet further embodiments, between about 95% and about 100% of a single cutter profile of the at least one cutting element 231 of the second plurality of cutting elements 231 may overlap with a cutter profile of a cutting element of the first plurality of cutting elements 230 of the at least one blade 214. The pocket 215 and the plurality of cutting elements 231 are described in greater detail in regard to FIGS. 3A-5.

Additionally, as is discussed in greater detail below, the at least one blade of the plurality of blades 214 may include one or more protrusions 233 trailing one or more of the second plurality of cutting elements 230, 231 in a direction of intended rotation (i.e., rotational direction) of the earth-boring tool 200. In particular, the one or more protrusions 233 may extend behind one or more of the second plurality of cutting elements 231 angularly toward a trailing edge of a respective blade 214. In some embodiments, each blade of the plurality of blades 214 of the earth-boring tool 200 may include one or more protrusions 233 trailing one or more of the second plurality of cutting elements 231. In other embodiments, only a subset of blades 214 of the plurality of blades 214 of the earth-boring tool 200 may include one or more protrusions 233 trailing one or more of the second plurality of cutting elements 231. For instance, alternating blades 214 may include one or more protrusions 233 trailing one or more of the second plurality of cutting elements 231 or two or more consecutive blades may include one or more protrusions 233 trailing one or more of the second plurality of cutting elements 231. The one or more protrusions 233 are described in greater detail in regard to FIGS. 3-7.

Figure 3A:
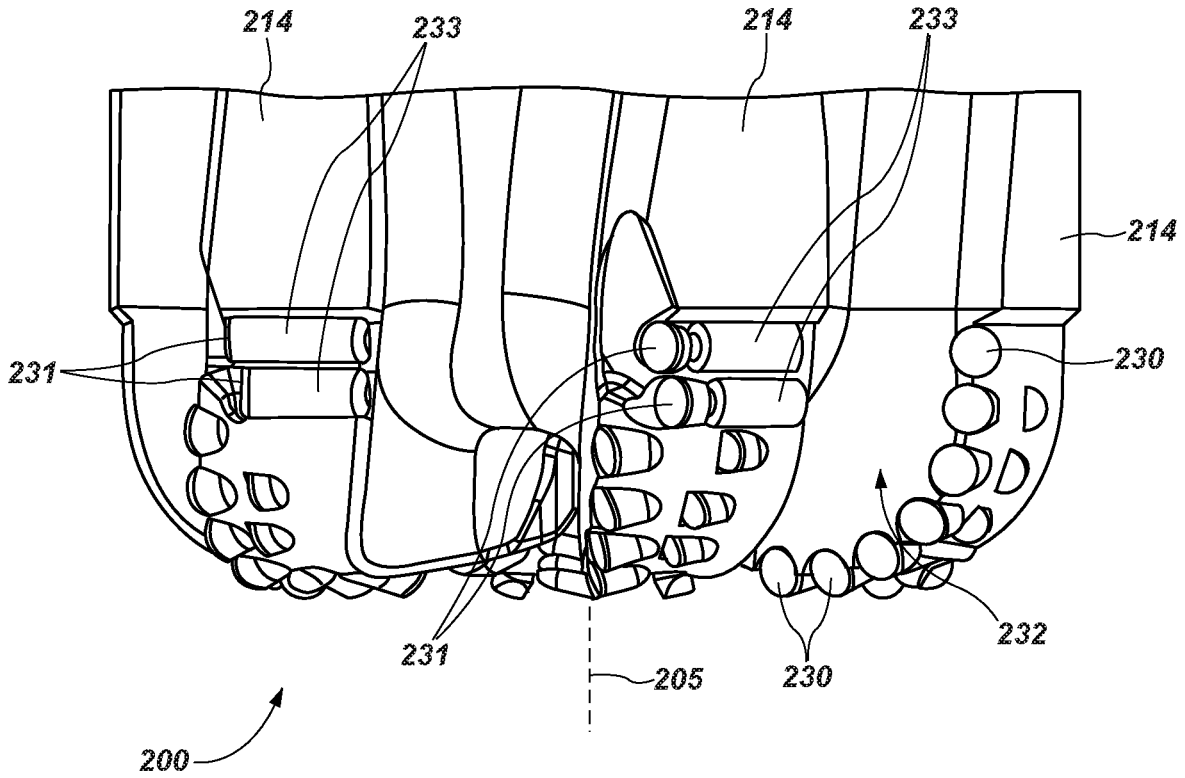
FIG. 3A is a partial perspective view of a blade of an earth-boring tool having a pocket formed therein and a plurality of protrusions formed thereon according to one or more embodiments of the present disclosure.
Figure 3B:
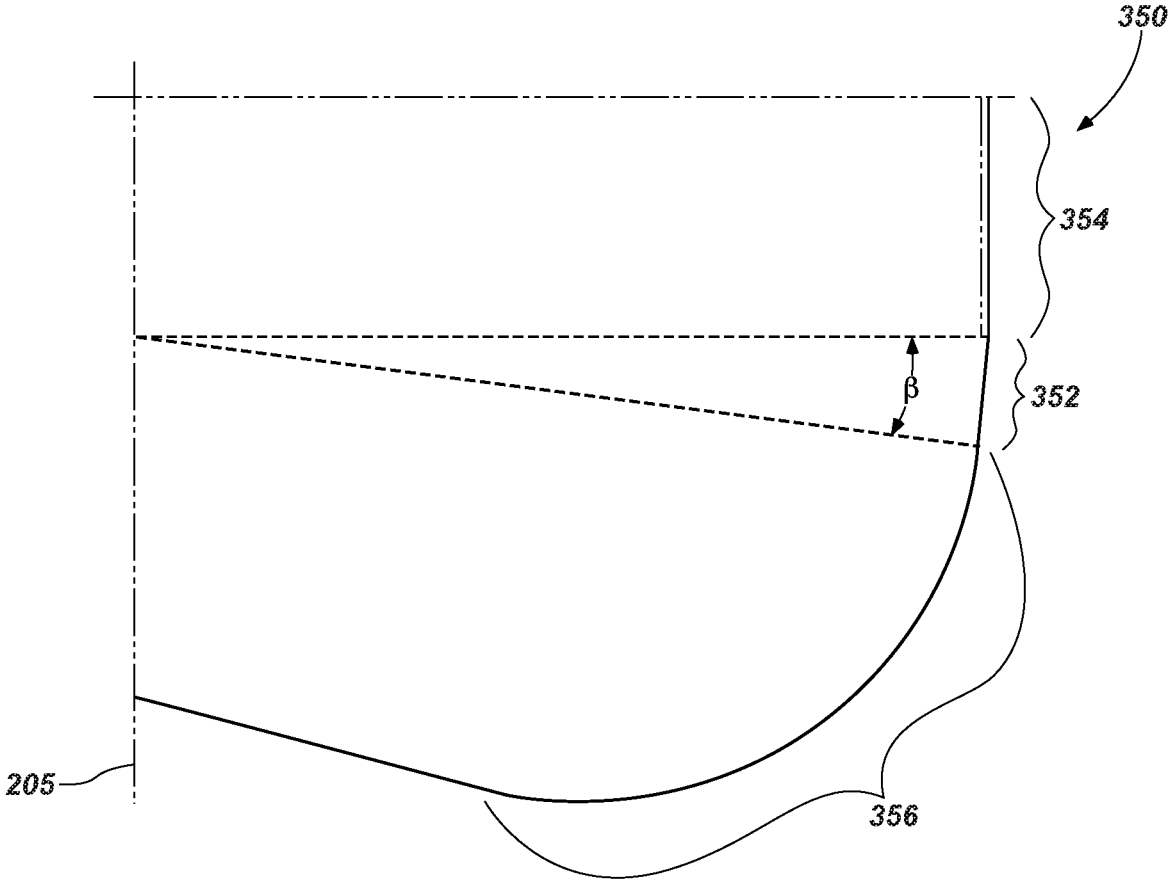
FIG. 3B shows a simplified representation of a profile of a blade of an earth-boring tool according to an embodiment of the present disclosure.
Figure 4:
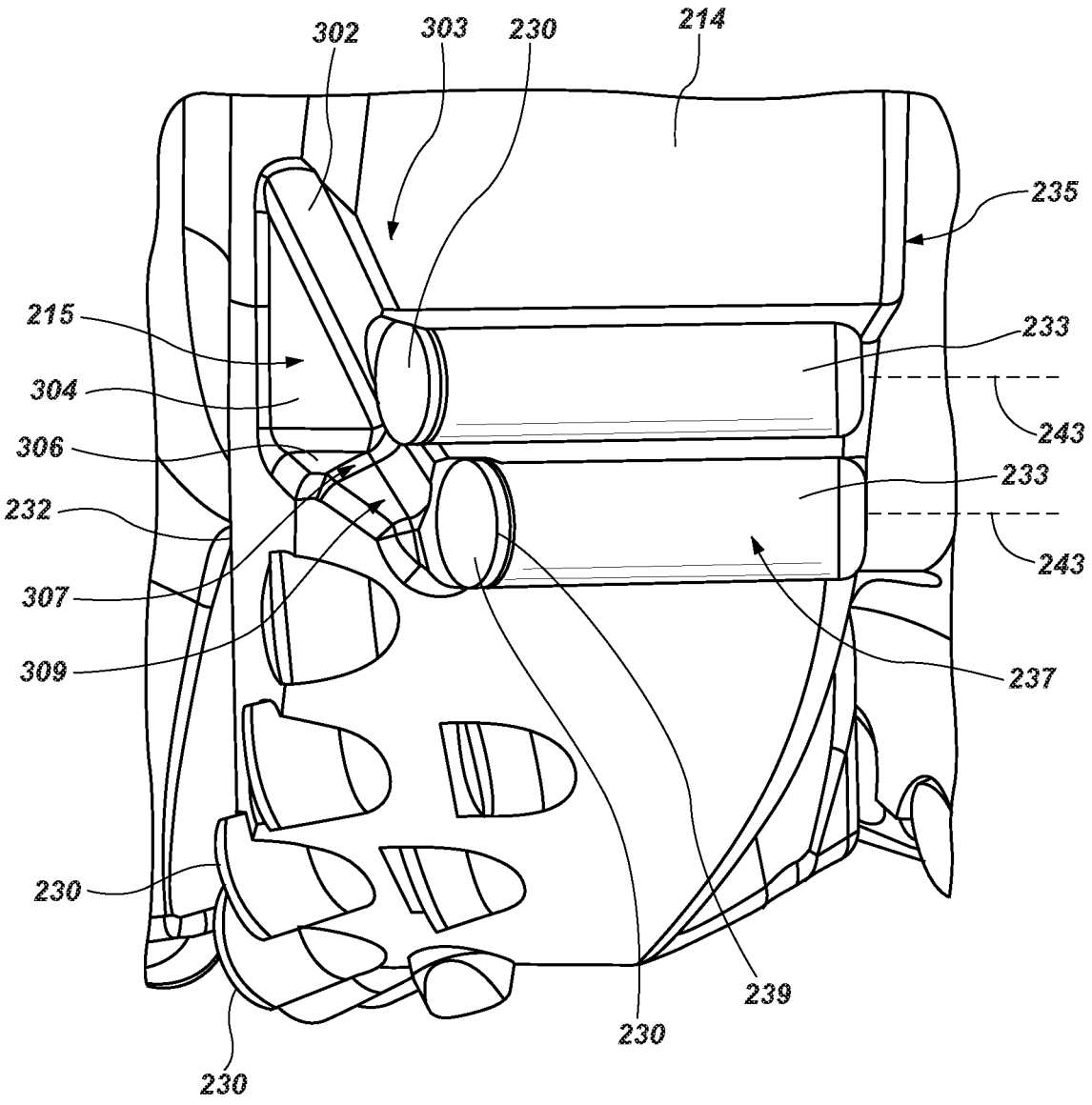
FIG. 4 is a partial perspective view of a blade of an earth-boring tool having a pocket formed therein and a plurality of protrusions formed thereon according to one or more embodiments of the present disclosure.
Figure 5:
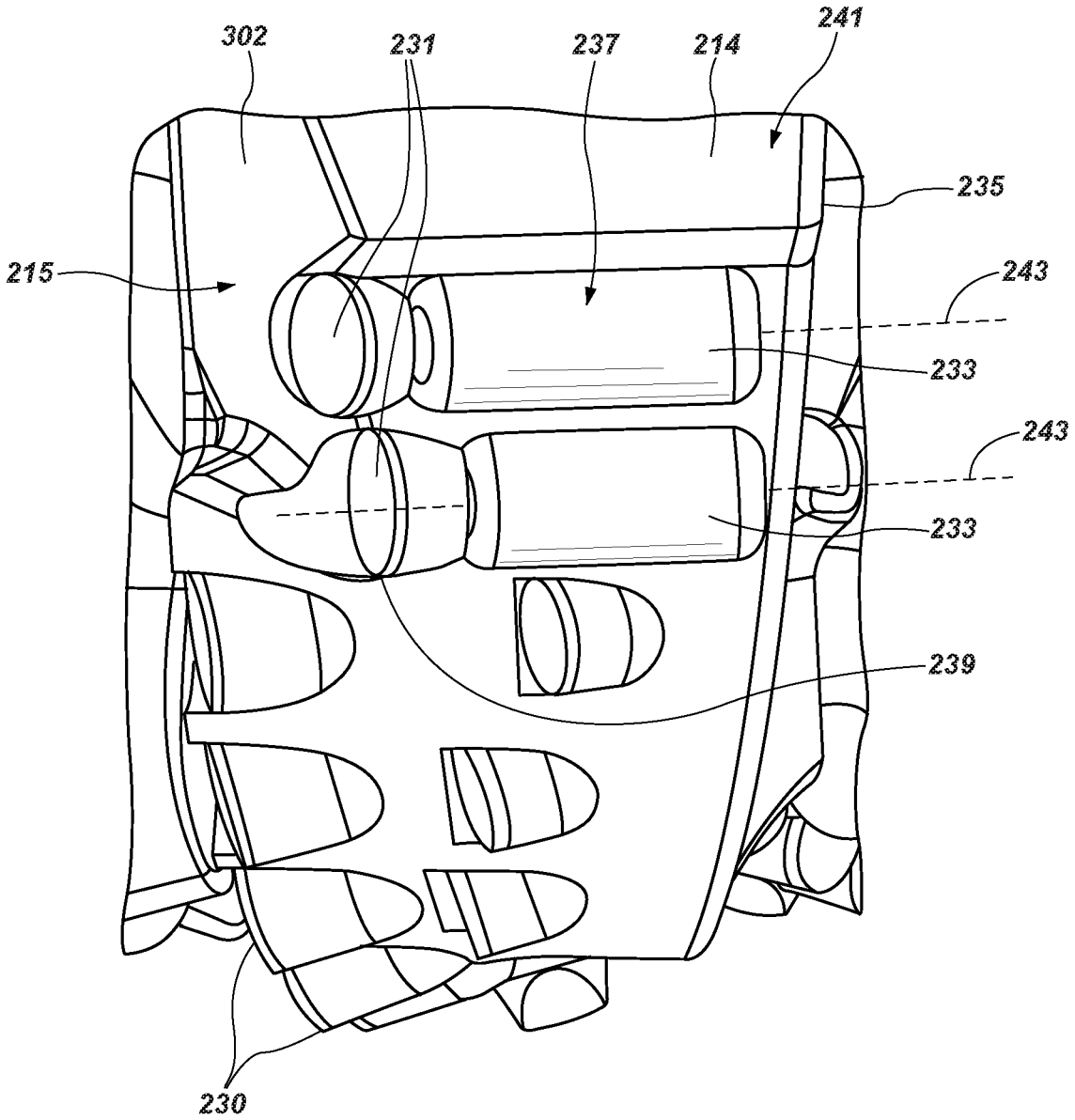
FIG. 5 is a partial perspective view of a blade of an earth-boring tool having a pocket formed therein and a plurality of protrusions formed thereon according to one or more additional embodiments of the present disclosure.

FIG. 3A is a partial perspective view of a plurality of blades 214 of the earth-boring tool of FIGS. 2A and 2B having one or more protrusions 233 trailing one or more of the second plurality of cutting elements 231. FIG. 3B shows a simplified representation of a profile 350 of a blade 214 of an earth-boring tool 200 (FIG. 2A) according to an embodiment of the present disclosure. FIG. 4 is a perspective view of a pocket 215 formed within a blade 214 of an earth-boring tool 200 and having one or more protrusions 233 trailing one or more of the second plurality of cutting elements 231 disposed within the pocket 215 according to one or more embodiments of the present disclosure. FIG. 5 is a perspective view of a pocket 215 formed within a blade 214 of an earth-boring tool 200 and having one or more protrusions 233 trailing one or more of the second plurality of cutting elements 231 disposed within the pocket 215 according to one or more additional embodiments of the present disclosure.

Referring to FIGS. 3A-5 together, in some embodiments, the pocket 215 may extend angularly into the blade 214 from rotationally leading face 232 of the blade 214 within at least a shoulder region of the blade 214 and about the center longitudinal axis 205 of the earth-boring tool 200.

As used herein, the shoulder region 352 of the blade 214 may include a portion of the blade 214 located within an angle β (see FIG. 3B) defined between a horizontal axis extending through an interface of the gage region 354 and the shoulder region 352 and an interface between the shoulder region 352 and a nose region 356 of the blade 214 and about an intersection of the horizontal axis and the center longitudinal axis 205 of the earth-boring tool 200. In some embodiments, the angle β may be within a range of about 5° and about 25°. For instance, the angle β may be about 15°.

Referring still to FIGS. 3A and 3B, the pocket 215 may extend angularly into the blade 214 in a direction opposite to a rotational direction of the earth-boring tool 200. Furthermore, the pocket 215 may extend radially inward (e.g., toward a center longitudinal axis 205 of the earth-boring tool 200) from a radially outermost surface 303 of the blade 214 within the shoulder region 352 or a shoulder region 352 and gage region 354 of the blade 214.

In some embodiments, for example as shown in FIG. 4, the pocket 215 may include a back surface 302, a side surface 304, and a lower surface 306. For instance, the pocket 215 may extend from the rotationally leading face 232 of the blade 214 and may terminate angularly at the back surface 302 of the pocket 215. For example, the back surface 302 may intersect the rotationally leading face 232 of the blade 214 and may extend from the rotationally leading face 232 of the blade 214. Additionally, the back surface 302 may form an obtuse angle with the rotationally leading face 232 of the blade 214. Furthermore, the pocket 215 may extend radially inward from the radially outermost surface 303 of the blade 214 and may terminate radially at the side surface 304.

In one or more embodiments, the side surface 304 may include a single side surface extending from the rotationally leading face 232 of the blade 214 to the back surface 302 of the pocket 215. The lower surface 306 may also extend from the rotationally leading face 232 of the blade 214 and may terminate angularly at the back surface 302 of the pocket 215. In some embodiments, the side surface 304 may be at least substantially planar, and the back surface 302 may be at least substantially planar. Additionally, the lower surface 306 of the pocket 215 may have an at least substantially planar portion 307 and one or more curved portions 309. The one or more curved portions 309 of the lower surface 306 may be proximate (e.g., adjacent) to the back surface 302 of the pocket 215. As is discussed in greater detail below, the one or more curved portions 309 of the lower surface 306 may enable the pocket 215 to extend at least partially behind one or more cutting elements 230 of the first plurality of cutting elements 230 disposed at leading face 232 of the blade 214 relative to a direction of rotation of the earth-boring tool 200. In some embodiments, the back surface 302, the side surface 304, and the lower surface 306 may define a general right triangle shape. In other words, the pocket 215 may have a general right triangle shape.

In some embodiments, the side surface 304 and the lower surface 306 may define an angle therebetween within the range of about 90° and about 130°. For instance, the side surface 304 and the lower surface 306 may define an angle of about 116° therebetween. Regardless, the back surface 302, the side surface 304, and the lower surface 306 of the pocket 215 may be exposed to an environment surrounding the earth-boring tool 200. In other words, the pocket 215 may be open. In one or more embodiments, the side surface 304 may define an angle with the rotationally leading face 232 of the blade 214 of about 60° to about 120°. For example, the side surface 304 may define an angle with the rotationally leading face 232 of the blade 214 of about 96°. Moreover, a radially innermost edge of the back surface 302 may define an angle with the rotationally leading face 232 of the blade 214 of about 20° to about 40°. For example, the radially innermost edge of the back surface 302 may define an angle with the rotationally leading face 232 of the blade 214 of about 29°.

Additionally, a radially outermost edge of the back surface 302 may define an angle with the rotationally leading face 232 of the blade 214 of about 20° to about 40°. For instance, the radially innermost edge of the back surface 302 may define an angle with the rotationally leading face 232 of the blade 214 of about 28°. Furthermore, the radially innermost edge of the back surface 302 may define an angle with a horizontal plane to which the center longitudinal axis 205 of the earth-boring tool 200 is normal of about 100° to about 120°. As a non-limiting example, the radially innermost edge of the back surface 302 may define an angle with a horizontal plane of about 108°. Also, the radially outermost edge of the back surface 302 may define an angle with a horizontal plane of about 100° to about 120°. For example, the radially outermost edge of the back surface 302 may define an angle with a horizontal plane of about 108°.

In some embodiments, the lower surface 306 of the pocket 215 may define an angle with the rotationally leading face 232 of the blade 214 of about 60° to about 120°. For example, the side surface 304 may define an angle with the rotationally leading face 232 of the blade 214 of about 96°. Additionally, the back surface 302 of the pocket 215 and the side surface 304 may define an angle within a range of about 90° to about 120°. For example, the back surface 302 of the pocket 215 and the side surface 304 may define an angle of about 105°.

In one or more embodiments, the pocket 215 may extend from the shoulder region 352 and partially into the gage region 354 of the blade 214. In some embodiments, between about 40% and about 80% of a total height of the pocket 215 (e.g., a height of the pocket 215 along the center longitudinal axis 205 of the pocket 215) may extend into the gage region 354 of the blade 214. For example, about 60% of the total height of the pocket 215 may extend into the gage region 354 of the blade 214. As used herein, a "height" of the pocket 215 may refer to a distance between a planar portion of the lower surface at an intersection of the lower surface with the leading face 232 of the blade 214 and an intersection of the back surface 302 within the leading face 232 of the blade 214. In one or more embodiments, the pocket 215 may have a height between about 1.00 inch and about 3.00 inches. Accordingly, between about 0.4 inches and about 2.40 inches of the pocket 215 may extend into the gage region 354. For instance, between about 0.6 inches and about 1.80 inches of the pocket 215 may extend into the gage region 354. In some embodiments, only the back surface 302 and the side surface 304 of the pocket 215 may extend into the gage region 354 of the blade 214.

In some embodiments, the pocket 215 may have a maximum width at a base of the pocket 215 and along the lower surface 306 of the pocket 215. For instance, the width of the pocket 215 may increase gradually from a zero width at a top of the pocket 215 to the maximum width at the base of the pocket 215. In some embodiments, at the base of the pocket 215, the pocket 215 may extend angularly (i.e., angularly about a longitudinal axis) for about 15° to about 25° about the center longitudinal axis 205 (FIG. 2B) of the earth-boring tool 200. In other words, an angle between a plane extending from the center longitudinal axis 205 (FIG. 2B) of the earth-boring tool 200 and along the rotationally leading face 232 of the blade 214, and a plane extending from the center longitudinal axis 205 (FIG. 2B) of the earth-boring tool 200 to the interface between the side surface 304 and the back surface 302 of the pocket 215 at the base of the pocket 215 may be about 15° to about 25°. Put yet another way, the interface of the side surface 304 and the back surface 302 at the base of the pocket 215 may trail the rotationally leading face 232 of the blade 214 along a direction of rotation of the earth-boring tool 200 by about 15° to about 25°. As will be understood by one of ordinary skill in the art, an amount by which the pocket 215 extends angularly at the base of the pocket 215 may vary based on bit size, cutter size, blade 214 thickness, etc.

In some embodiments, as noted above, a portion of the pocket 215 may extend at least partially behind at least one cutting element 230 of the first plurality of cutting elements 230 disposed along the rotationally leading face 232 of the blade 214 along a rotational pathway defined by the at least one cutting element 230 during a rotation of the earth-boring tool 200. Furthermore, as discussed above in regard to FIGS. 2A and 2B, the pocket 215 may house a second plurality of cutting elements 231. Additionally, a rotational pathway (defined by a rotation of the earth-boring tool 200) of at least one cutting element 231 of the second plurality of cutting elements 231 within the pocket 215 may at least partially overlap a rotational pathway of a cutting element 230 of the first plurality of cutting elements 230 disposed at the rotationally leading face 232 of the blade 214 in which the pocket 215 is defined. For instance, the rotational pathway of at least one cutting element 231 may overlap the rotational pathway of the cutting element 230 by any of the amounts described above. Put another way, within a cutting profile of the earth-boring tool 200 defined by the first and second pluralities of cutting elements 230, 231 during a full rotation of the earth-boring tool 200, at least one cutting element 231 housed by the pocket 215 may at least partially overlap with a cutting element 230 disposed at the rotationally leading face 232 of the blade 214 within which the pocket 215 is formed. Cutting elements 231 of the second plurality of cutting elements 231 that overlap with cutting elements of the first plurality of cutting elements 230 are referred to hereinafter as "shadow cutting elements 233." In some embodiments, the earth-boring tool 200 may include two or more shadow cutting elements 233 within a single pocket 215 of a single blade 214.

In some embodiments, at least one cutting element 231 of the second plurality of cutting elements 231 disposed within the pocket 215 may be disposed within the shoulder region 352 of the blade 214, and at least one other cutting element 231 of the second plurality of cutting elements 231 may be disposed within a gage region of the blade 214. In other embodiments, all of the cutting elements 231 of the second plurality of cutting elements 231 may be disposed within the shoulder region 352 of the blade 214. Moreover, in one or more embodiments, cutting faces of the second plurality of cutting elements 231 may be angled relative to the back surface 302 of the pocket 215. For example, the back surface 302 of the pocket 215 may define an angle with the cutting faces of the second plurality of cutting elements 231 within a range of about 5° and about 15°. In some embodiments, the back surface 302 of the pocket 215 may define an angle of about 10°. Furthermore, an orientation of the back surface 302 (e.g., an angle of the back surface 302 relative to the rotationally leading face 232 of the blade 214) may be determined (e.g., formed) based on a rake of the cutting faces of the second plurality of cutting elements 231 housed within the pocket 215. In some embodiments, the second plurality of cutting elements 231 within the pocket 215 may have a back rake within a range of about 30° to about 50°. For example, the second plurality of cutting elements 231 within the pocket 215 may have a back rake of about 40°. The first plurality of cutting elements 230 disposed along the rotationally leading face 232 of the blade 214 may have a back rake within a range of about 25° to about 35°. For instance, the first plurality of cutting elements 230 disposed along the rotationally leading face 232 of the blade 214 may have a back rake of about 30°.

Referring to FIGS. 2A-3B together, in one or more embodiments, the earth-boring tool 200 may include a pocket 215 (as described above) in each of a plurality of blades 214 of the earth-boring tool 200. Additionally, in some embodiments, the earth-boring tool 200 may include pockets 215 formed in two or more blades 214. In some instances, the earth-boring tool 200 may include pockets 215 formed in two, three, four, five, or six consecutive blades 214. In further embodiments, the earth-boring tool 200 may include pockets 215 formed in three consecutive blades 214 of six total blades 214 of the earth-boring tool 200. For instance, the earth-boring tool 200 may include pockets 215 formed in three consecutive (side-by-side) blades 214 having the uppermost (e.g., axially uppermost) cutting elements 230 of the first plurality of cutting elements 230 disposed within shoulder regions of the blades 214. In additional embodiments, the earth-boring tool 200 may include pockets 215 formed in alternating blades 214 (e.g., every other blade 214) of the earth-boring tool 200. As is discussed in greater detail below in regard to FIGS. 5 and 6, the pockets 215 may enable an earth-boring tool 200 to include an increased number of cutting elements within the shoulder region 352 of the earth-boring tool 200 while maintaining a relatively short cutting profile height to maintain stability and directional responsiveness in directional drilling without sacrificing durability.

In embodiments including a plurality of pockets 215 (e.g., pockets formed in a plurality of different blades 214), each pocket 215 of the plurality of pockets 215 may have a different height relative to the other pockets 215 of the plurality of pockets 215. For instance, a height of a given pocket 215 of the plurality of pockets 215 may be determined based on locations and orientations of cutting elements 231 of the second plurality of cutting elements 231 within the given pocket 215. For example, an intersection of the back surface 302 of the given pocket 215 and the leading face 232 of a respective blade 214 may be defined based on the locations and orientations of the cutting elements 231 within the given pocket 215. For example, as discussed above, an angle of the back surface 302 and, as a result, the intersection of the back surface 302 and the leading face 232, is determined based on the orientations of the cutting faces of the cutting elements 231. In alternative embodiments, two or more of the plurality of pockets 215 may have a same height. In additional embodiments, all of the plurality of pockets 215 may have a same height.

In view of the foregoing and the following, the height of the pocket 215 (e.g., location of the intersection of the back surface 302 of the pocket 215 with the leading face 232 of the blade 214) and an angle of the back surface 302 formed with the leading face 232 of the blade 214 may enable the pocket 215 to "self-clear." For instance, during a typical rotation of the earth-boring tool 200, cuttings (e.g., debris) producing from the earth-boring tool 200 and drilling operations may naturally enter the pocket 215, and the angle of the back surface 302 and location of the intersection of the back surface 302 of the pocket 215 with the leading face 232 of the blade 214 may cause drilling fluids, generally referred to in the industry as "mud" to naturally enter the pocket 215 and push out cuttings and other debris within the pocket 215. Furthermore, as is discussed in greater detail below in regard to FIG. 4, nozzles may be oriented proximate to the pockets 215 to assist in keeping the pockets 215 clear from debris and functioning properly.

Referring to FIG. 4, in some embodiments, a given protrusion 233 of the earth-boring tool 200 may trail a given cutting element of the second plurality of cutting elements 231 in a direction of intended rotation of the earth-boring tool 200. For example, the given protrusion 233 may extend from the respective cutting element 231 toward a trailing edge 235 of the respective blade 214 on which the given protrusion 233 is formed.

In one or more embodiments, the given protrusion 233 may abut against a respective cutting element 231. For example, a cutting element pocket in which the respective cutting element 231 is secured within the blade 214 may be at least partially formed within the given protrusion 233. Furthermore, the given protrusion 233 may at least partially encompass (e.g., surround) a base portion of the respective cutting element 231. Additionally, in some embodiments, the given protrusion 233 may extend around an outer lateral side surface of the respective cutting element 231 to a location proximate a cutting table (e.g., diamond table) of the respective cutting element 231. To facilitate description of the protrusions 233 of the present disclosure, in embodiments where a protrusion 233 extends around an outer lateral side surface of a cutting element 231 to a location proximate (e.g., a same angular position as) a cutting table of the cutting element 231, the protrusion 233 may be referred to herein as a "connected protrusion."

In some embodiments, a cross-section of a given protrusion 233 along a plane to which a center longitudinal axis 243 of the protrusion 233 is normal may generally match at least a portion of a cutting profile defined by the respective cutting element 231. For example, a curvature of an outer lateral surface 237 of the protrusion 233 may at least substantially match a curvature of a cutting profile defined by an outermost radial edge 239 of the cutting element 231. For instance, the given protrusion 233 may have a shape similar to a shape defined by extending the outermost radial edge 239 of the respective cutting element 231 toward the trailing edge 235 of a respective blade 214. As a result, in some embodiments, the outermost radial surface 237 of a given protrusion 233 may include a cylindrical surface. Moreover, depending on a back rake and/or side rake of the respective cutting element 231, the outer lateral surface 237 of the protrusion 233 may have an elliptic-cylindrical surface. In other embodiments, the outermost radial surface 237 of a given protrusion 233 may have a shape different than that shape of the outermost radial edge 239 of the respective cutting element 231. For instance, the outermost radial surface 237 of a given protrusion 233 may have a general rectangular cross-section, a triangular cross-section, a truncated cylindrical cross-section, or any other shaped cross-section along a plane to which a center longitudinal axis 243 of the protrusion 233 is normal.

In one or more embodiments, a given protrusion 233 of a respective cutting element 231 may extend outward radially from the center longitudinal axis 205 a same distance as the outermost radial edge 239 of the respective cutting element 231. Additionally, in some embodiments, the given protrusion 233 of the respective cutting element 231 may extend completely across a lateral side of the respective blade 214 to the trailing edge 235 of the respective blade 214. In other embodiments, the given protrusion 233 of the respective cutting element 231 may extend across between about 50% and about 95% of the width of the respective blade 214. In further embodiments, the given protrusion 233 of the respective cutting element 231 may extend across between about 70% and about 95% of the width of the respective blade 214. In yet further embodiments, the given protrusion 233 of the respective cutting element 231 may extend across between about 80% and about 95% of the width of the respective blade 214.

In some embodiments, the given protrusion 233 of the respective cutting element 231 may extend longitudinally in a direction at least substantially perpendicular to and about the center longitudinal axis 205 (FIG. 2A) of the earth-boring tool 200. Additionally, the given protrusion 233 of the respective cutting element 231 may extend longitudinally in a direction that is collinear with an intended trajectory of travel of the respective cutting element 231 during a drilling procedure. For instance, the given protrusion 233 of the respective cutting element 231 may sweep behind the respective cutting element 231 in a direction that is collinear with an intended trajectory of the respective cutting element 231. Furthermore, as is discussed in greater detail below, in operation, a given protrusion 233 of a given cutting element 231 may pass through grooves (e.g., cuttings) formed in a formation by the given cutting element 231 during rotation of the earth-boring tool 200. As will be appreciated by one of ordinary skill in the art, the intended trajectory of travel of the respective cutting element 231 may vary depending on whether the earth-boring tool 200 is utilized with a rotary drill motor (on-center drill bit) or an adjustable kick off ("AKO") motor (off-center drill bit). For instance, a cutter trajectory is a function of an axial displacement through a single revolution of the earth-boring tool, and the cutter trajectory may define a helical trajectory at a given cutting element's 231 radial position on the earth-boring tool through which the given cutting element 231 is passed during the rotation. In some embodiments, a projected geometry of a protrusion 233 (e.g., a geometry of the protrusion determined by sweeping a cutting profile of a respective cutting in a trailing direction from the respective cutting element along the intended trajectory of the cutting element) may be extended (e.g., swept) at a radial arc different to that of the radial location of the cutting element 231 it the protrusion is trailing. In particular, the cutting element 232 may be at a particular radial distance measured from the center longitudinal axis 205 of the earth-boring tool 200; however, in the case of an AKO motor, wherein the center longitudinal axis 205 is not aligned with a center of a drilling hole, then a cutting element 231 trajectory radial arc would be greater than that of the cutting element 231 radius. Additionally, in embodiments wherein the earth-boring tool 200 is rotating on a motor and an associated drill string is also rotating, the cutting element trajectory radial arc would be less than that of the cutting element radius and would be dependent on the ratio of drill string to motor RPM.

In one or more embodiments, the outermost radial surface 237 of a given protrusion 233 of a respective cutting element 231 may extend radially outward to a maximum diameter of the earth-boring tool 200. For instance, the outermost radial surface 237 of a protrusion 233 of a cutting element 231 most proximate a gage region 241 of a respective blade 214 may extend out to a full gage width of the earth-boring tool. In other embodiments, the outermost radial surface 237 of one or more protrusions 233 may be more radially inward relative to the gage region 241 of a respective blade 214. For example, in some embodiments, the protrusion 233 of the cutting element 231 and the gage region 241 of the respective blade 214 may form a general stepped gage region. Additionally, in some embodiments, the outermost radial surface 237 of a first protrusion 233 of a first cutting element 231 may extend out to a full gage width of the earth-boring tool 200, and the outermost radial surface 237 of a second protrusion 233 of a second cutting element 231 may be more radially inward relative to the gage region 241 of a respective blade 214.

In some embodiments, the one or more protrusions 233 may be integrally formed with the body 202 of the earth-boring tool 200. Furthermore, the one or more protrusions 233 and the body 202 may be formed of any material include, for example, tungsten carbide, blends, diamond-impregnated materials, steel, hardfacing, etc. In additional embodiments, the one or more protrusions 233 may include one or more inserts disposed within one or more recesses formed adjacent to respective cutting elements 231. For instance, the one or more protrusions 233 may include one or more polycrystalline hard material inserts or tungsten carbide inserts. Furthermore, in some embodiments, the one or more protrusions may include impregnated posts and/or thermal stable polycrystalline diamond materials.

In one or more embodiments, the center longitudinal axis 243 of a given protrusion 233 may be linear. In additional embodiments, the center longitudinal axis 243 of a given protrusion 233 may be arcuate. Furthermore, the center longitudinal axes 243 of the protrusions 233 of the earth-boring tool 200 may vary from protrusion 233 to protrusion 233.

In some embodiments, the center longitudinal axis 243 of a given protrusion 233 may define an acute angle with a plane to which the center longitudinal axis 205 is orthogonal. In some embodiments, the acute angle may be within a range of about 0.01° and about 25.0°. In additional embodiments, the acute angle may be within a range of about 0.01° and about 15.0°. In further embodiments, the acute angle may be within a range of about 0.01° and about 5.0°.

In one or more embodiments, longitudinal lengths of protrusions 233 formed on a same blade 214 may vary. For instance, a longitudinal length of a protrusion 233 may be at least partially determined by an angular position of its associated cutting element 231 about the longitudinal axis 205 of the earth-boring tool 200 and a width of a respective blade 214.

Referring to FIG. 5, in some embodiments, a given protrusion 233 may be at least partially separated from and segmented from the outermost radial edge 239 of a respective cutting element 231. To facilitate description of a protrusion 233 that is separated and segmented from a respective cutting element 231, such a protrusion 233 is referred to hereinafter as a "separated protrusion." For instance, a gap (e.g., valley) may be defined between a longitudinal end of the separated protrusion 233 and the outermost radial edge 239 or cutting table of a respective cutting element 231. In such embodiments, the separated protrusion 233 may still surround at least a portion of a base portion of its respective cutting element 231. Additionally, in some instances, the separated protrusion 233 may be wholly separated from its respective cutting element 231 and may not surround any portion of the base portion of the respective cutting element 231.

In some embodiments, the earth-boring tool 200 may include at least one blade 214 having one or more separated protrusions 233 associated with respective cutting elements 231 and at least one blade 214 having one or more connected protrusions 233 associated with respective cutting elements 231. Additionally, in one or more embodiments, a given blade 214 of the earth-boring tool 200 may include at least one separated protrusion 233 associated with a respective cutting element 231 and at least one connected protrusion 233 associated with a respective cutting element 231.

Referring to FIGS. 2A-5 together, although the one or more protrusions are depicted as being associated with backup cutting elements 231 and/or shadow cutting elements 231 within a pocket 215, the disclosure is not so limited. For example, the earth-boring tool 200 may include any of the above-described protrusions 233 associated with primary cutting elements (e.g., the first plurality of cutting elements 230) disposed at a leading face of a blade 214 and/or any other conventional cutting elements (e.g., Stay-True cutters, chisel cutters, etc.). Furthermore, the earth-boring tool 200 may include any of the above-described protrusions 233 in one or more of the cone region, the nose region, the shoulder region, or the gage region of the earth-boring tool 200.

Earth-boring tools having the one or more protrusions 233 may provide advantages over conventional earth-boring tools. For example, during a drilling operation, the one or more protrusions 233 may be swept along a cutting element trajectory and may be configured to engage a formation outside of the intended trajectory to at least partially prevent or reduce lateral displacement during the drilling operation. Reducing lateral displacement during drilling operations may also improve accuracy in drilling operations. For instance, reducing lateral displacement may reduce a likelihood that an earth-boring tool will drill in an unintended direction. Additionally, the one or more protrusions 233 may provide designated rubbing areas and may reduce an overall rubbing area, and as a result, wear in comparison to conventional earth-boring tools.

Figure 6A:
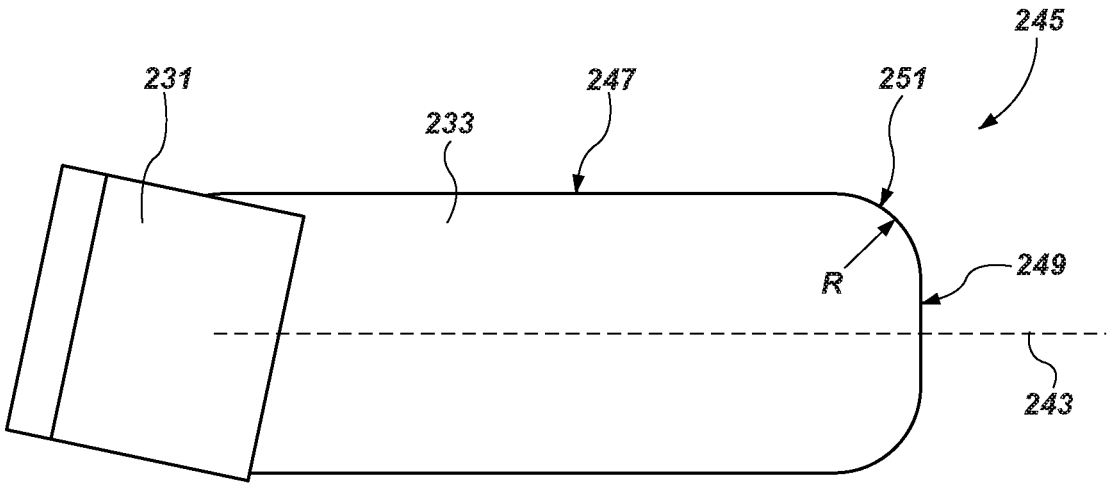
FIG. 6A is a schematic representation of a cutting element and protrusion according to one or more embodiments of the present disclosure.

FIG. 6A is a schematic representation of a cutting element 231 and an associated protrusion 233. The view depicted in FIG. 6A is from a plane to which the longitudinal axis 205 (FIG. 2A) of the earth-boring tool 200 (FIG. 2A) is normal. In particular, the view depicted in FIG. 6A is from below the cutting element 231 and the associated protrusion 233 depicted in FIGS. 2A and 3. As shown in FIG. 6A, in some embodiments, a longitudinal end 245 of the protrusion 233 opposite the cutting element 231 may include an outer lateral surface 247 of the protrusion 233 that transitions to a longitudinal end surface 249 of the protrusion 233 with a rounded surface 251 having a curvature. In some embodiments, the radius of curvature may be within a range of about 0.50 inch and about 0.0625 inch. For example, the radius of curvature may be about 0.0325 inch.

Figure 6B:
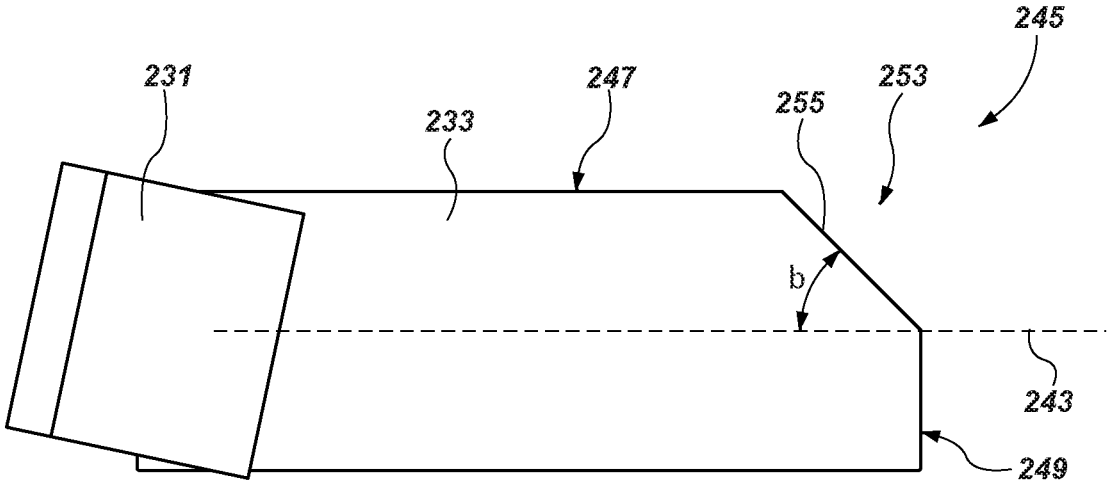
FIG. 6B is a schematic representation of a cutting element and protrusion according to one or more additional embodiments of the present disclosure.

FIG. 6B is a schematic representation of a cutting element 231 and an associated protrusion 233. Like the view of FIG. 6A, the view depicted in FIG. 6B is from a plane to which the longitudinal axis 205 (FIG. 2A) of the earth-boring tool 200 (FIG. 2A) is normal. In particular, the view depicted in FIG. 6B is from below the cutting element 231 and the associated protrusion 233 depicted in FIGS. 2A and 3. As shown in FIG. 6B, in some embodiments, a longitudinal end 245 of the protrusion 233 opposite the cutting element 231 may include an outer lateral surface 247 of the protrusion 233 that transitions to a longitudinal end surface 249 of the protrusion 233 with a chamfered edge 253. In some embodiments, a chamfer surface 255 of the chamfered edge 253 may form an angle β with the longitudinal axis 243 of the protrusion 233. In some embodiments, the angle β may be within a range of about 5° and about 90°. For example, the angle β may be about 35°.

Figure 7:
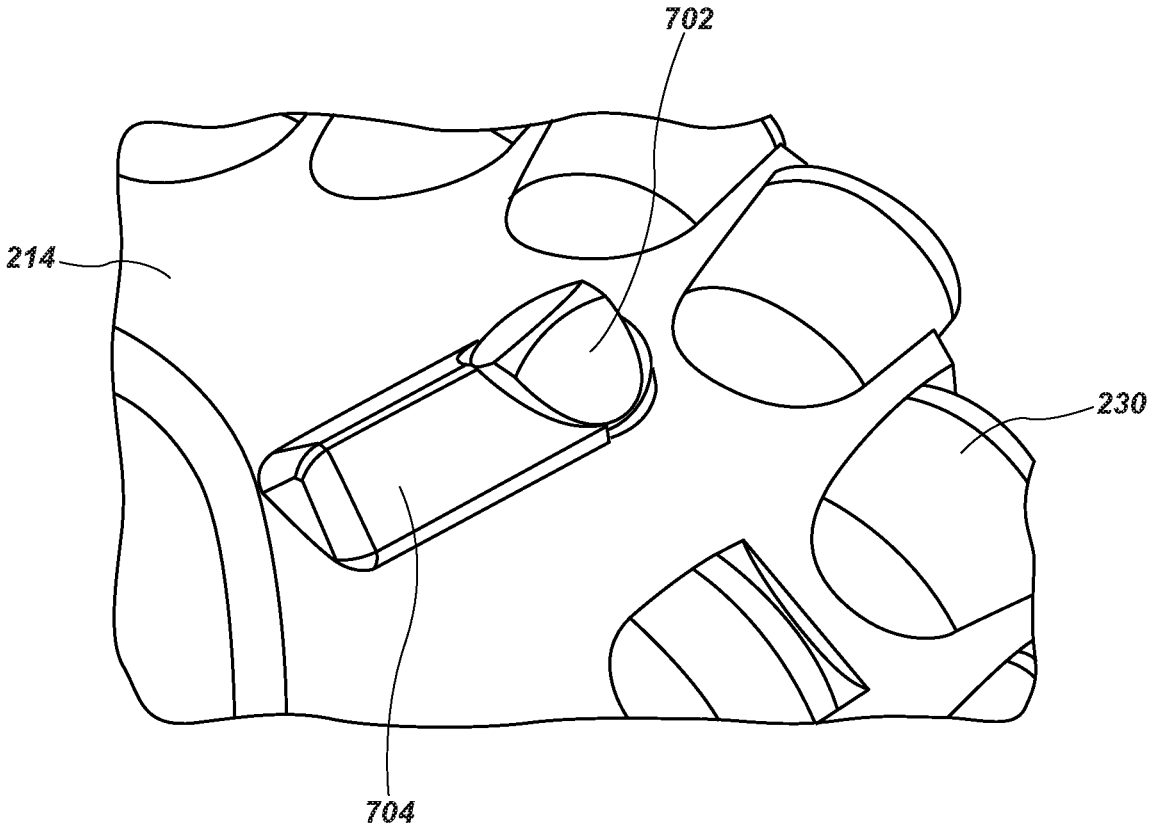
FIG. 7 is a bottom view of a blade having a cutting element disposed therein and a protrusion formed thereon according to one or more additional embodiments of the present disclosure.

FIG. 7 is a bottom perspective view of a blade 214 having a cutter 702 and a protrusion 704 trailing the cutter 702 in a direction of intended rotation of an earth-boring tool according to one or more embodiments of the present disclosure. For example, as noted above, in some embodiments, the protrusion 704 may be associated with any conventional cutter (e.g., a chisel cutter, gage cutter, primary cutter, backup cutter, shadow cutter, etc.) and may be formed anywhere on a blade 214. Furthermore, as shown in FIG. 7, in some embodiments, a cross-section of the protrusion 704 along a plane perpendicular to a center longitudinal axis 243 of the protrusion 704 may generally match at least a portion of a cutting profile defined by the cutter 702. For instance, the protrusion 704 may have a general triangular cross-section when the cutter comprises a chisel cutter (e.g., the cutter 702 depicted in FIG. 7).

Figure 8:
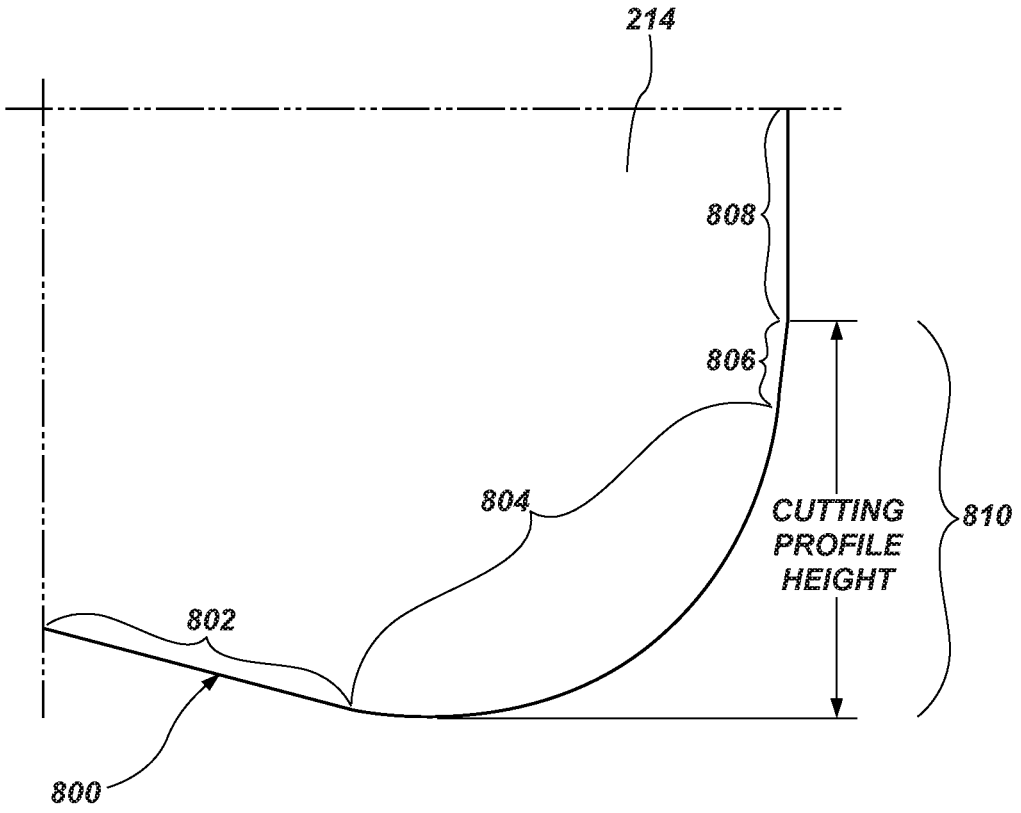
FIG. 8 is partial schematic view of a blade profile according to an embodiment of the present disclosure.

FIG. 8 shows a simplified schematic representation of a portion of a profile 800 of a blade 214 of an earth-boring tool 200 (FIG. 2A) according to an embodiment of the present disclosure. The profile 800 may include a cone line 802, a nose arc 804, a shoulder arc 806, and a gage line 808. As will be understood by one of ordinary skill in the art, the cone line 802 may extend through a cone region of the blade 214, the nose arc 804 may extend throughout a nose region of the blade 214, the shoulder arc 806 may extend through a shoulder region of the blade 214, and the gage line 808 may extend along a gage region of the blade 214.

As is shown in FIG. 8, a cutting profile height of a cutting profile 810 defined by the cutting elements of the blades 214 of the earth-boring tool 200 (FIG. 2A) may include an axial length (e.g., a length along an axial length of the earth-boring tool 200 (FIG. 2A)) between a bottom of the nose arc 804 of the blade 214 and a bottom of the gage line 808 (i.e., an interface of the shoulder arc 806 and the gage line 808) of the blade 214.

In some embodiments, a ratio of a cutting profile height of the earth-boring tool 200 (FIG. 2A) and a drill bit diameter of the earth-boring tool 200 (FIG. 2A) may be within a range of about 0.15 and about 0.35. In some embodiments, a ratio of a cutting profile height of the earth-boring tool and a diameter of the earth boring tool is greater than about 0.15. For instance, the ratio may be within a range of about 0.15 and 0.25. As a non-limiting example, the ratio may be about 0.18. As a non-limiting example, in some embodiments, the cutting profile height may be about 1.56 inches and the drill bit diameter may be about 8.5 inches.

Figure 9:
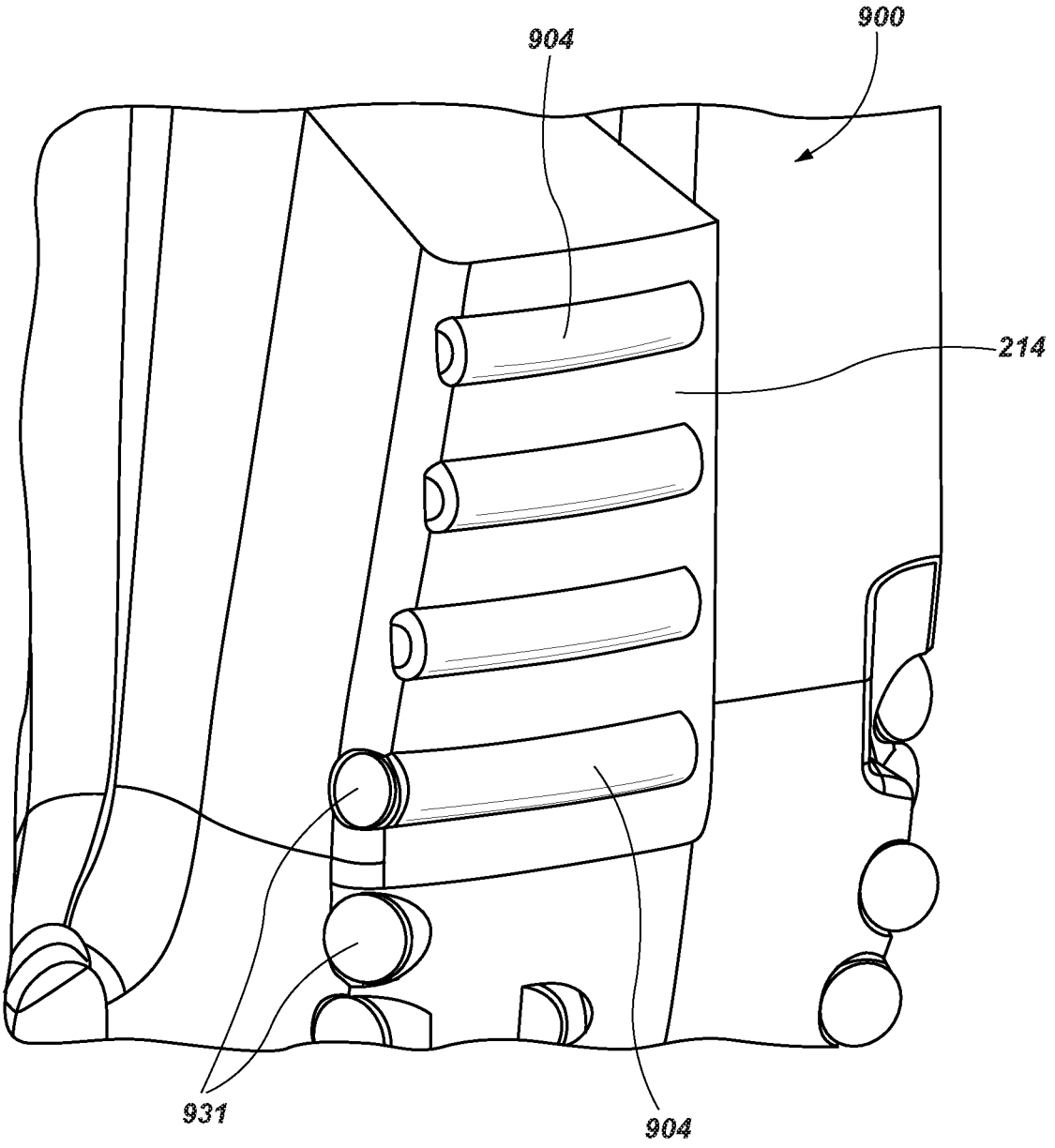
FIG. 9 is a partial perspective view of a blade of an earth-boring tool having a plurality of protrusions formed thereon according to one or more embodiments of the present disclosure.

FIG. 9 shows an earth-boring tool 900 having protrusions 904 located within gage regions of blades 214 according to additional embodiments of the present disclosure. As shown in FIG. 9, in some embodiments, the protrusions 904 may be associated with a respective cutting element 931 and may trail the cutting element 931 in a direction of intended rotation of the earth-boring tool 900. In additional embodiments, the protrusions 904 may be stand alone and may not be associated with any particular cutting element 931. For example, the protrusions 804 may not trail any particular cutting element 931. In one or more embodiments, the protrusions 904 may extend in at least substantially a horizontal direction. In some embodiments, a given blade 214 may include one or more protrusions 904 associated with one or more cutting elements 931 and one or more standalone protrusions 904, as depicted in FIG. 9.

The disclosure further includes the following embodiments:

Embodiment 1

An earth-boring tool, comprising: a body including a plurality of blades, each blade of the plurality of blades extending axially and radially relative to a center longitudinal axis of the body; a plurality of cutting elements secured within the plurality of blades; and at least one protrusion trailing at least one cutting element of the plurality of cutting elements in a direction of intended rotation of the earth-boring tool and extending along a lateral side of a blade of the plurality of blades in which the at least one cutting element is secured, wherein the at least one protrusion extends around an outer lateral side surface of the cutting element to at least substantially a same angular position about a center longitudinal axis of the earth-boring tool as a cutting table of the at least one cutting element.

Embodiment 2

The earth-boring tool of embodiment 1, wherein an acute angle is defined between the longitudinal axis of the at least one protrusion and a plane to which the center longitudinal axis of the earth-boring tool is normal.

Embodiment 3

The earth-boring tool of embodiment 1, wherein a gap is defined between a longitudinal end of the protrusion and a diamond table of the at least one cutting element.

Embodiment 4

The earth-boring tool of embodiments 1-3, wherein a curvature of an outer lateral surface of the at least one protrusion matches a curvature of an outermost radial edge of the at least one cutting element.

Embodiment 5

The earth-boring tool of embodiments 1-4, wherein only a subset of blades of the plurality of blades has at least one protrusion formed thereon.

Embodiment 6

The earth-boring tool of embodiments 1-5, wherein the outer lateral surface of the at least one protrusion comprises a cylindrical outer surface.

Embodiment 7

The earth-boring tool of embodiments 1-6, wherein the at least one cutting element comprises a cutting element secured at a least face of a blade of the plurality of blades.

Embodiment 8

The earth-boring tool of embodiments 1-6, wherein the at least one cutting element comprises a backup cutting element.

Embodiment 9

The earth-boring tool of embodiments 1-6, wherein the at least one cutting element comprises a shadow cutting element.

Embodiment 10

An earth-boring tool, comprising: a body including a plurality of blades, each blade of the plurality of blades extending axially and radially relative to a center longitudinal axis of the body, at least one blade of the plurality of blades having a pocket extending into the at least one blade from a rotationally leading face of the at least one blade in at least a shoulder region of the at least one blade; a first plurality of cutting elements secured along rotationally leading faces of the plurality of blades; and a second plurality of cutting elements secured to the at least one blade of the plurality of blades proximate a back surface of the at least one pocket; and at least one protrusion trailing at least one cutting element of the second plurality of cutting elements in a direction of intended rotation of the earth-boring tool and extending along a lateral side of the at least one blade of the plurality of blades in which the at least one cutting element is secured.

Embodiment 11

The earth-boring tool of embodiment 10, wherein the at least one protrusion comprises a longitudinal end comprising an outer lateral surface that transitions to a longitudinal end surface via a rounded surface.

Embodiment 12

The earth-boring tool of embodiment 11, wherein the rounded surface comprises a radius of curvature within a range of about 0.0625 inch and about 0.50 inch.

Embodiment 13

The earth-boring tool of embodiment 10, wherein the at least one protrusion comprises a longitudinal end comprising an outer lateral surface that transitions to a longitudinal end surface via a chamfer surface.

Embodiment 14

The earth-boring tool of embodiment 13, wherein an angle is defined between the chamfer surface and a longitudinal axis of the at least one protrusion, and wherein the angle is within a range of about 5° and about 90°.

Embodiment 15

The earth-boring tool of embodiments 10-14, wherein a longitudinal axis of the at least one protrusion is at least substantially collinear with an intended trajectory of the at least one cutting element during a drilling operation.

Embodiment 16

The earth-boring tool of embodiments 10-15, further comprising at least one additional protrusion trailing at least one cutting element of the first plurality of cutting elements in a direction of intended rotation of the earth-boring tool and extending along the lateral side of the at least one blade of the plurality of blades in which the at least one cutting element is secured.

Embodiment 17

The earth-boring tool of embodiments 10-16, wherein an acute angle is defined between the longitudinal axis of the at least one protrusion and a plane to which the longitudinal axis of the earth-boring tool is normal.

Embodiment 18

The earth-boring tool of embodiment 17, wherein the acute angle is within a range of about 5° and about 25°.

Embodiment 19

The earth-boring tool of embodiments 10-18, wherein the at least one protrusion is integrally formed with the body of the earth-boring tool.

Embodiment 20

A method of forming an earth-boring tool, comprising: forming a body of an earth-boring tool including a plurality of blades and at least one protrusion extending across at least a portion of a lateral side of at least one blade of the plurality of blades and having an outer lateral surface having a curvature that at least substantially matches a predicted cutting profile of an associated cutting element; securing a plurality of cutting elements with the plurality of blades; and securing at least one cutting element proximate the at least one protrusion such that the at least one protrusion trails the at least one cutting element in a direction of intended rotation of the earth-boring tool, the at least one cutting element having the predicted cutting profile.

The embodiments of the disclosure described above and illustrated in the accompanying drawings do not limit the scope of the disclosure, which is encompassed by the scope of the appended claims and their legal equivalents Any equivalent embodiments are within the scope of this disclosure. Indeed, various modifications of the disclosure, in addition to those shown and described herein, such as alternate useful combinations of the elements described, will become apparent to those skilled in the art from the description. Such modifications and embodiments also fall within the scope of the appended claims and equivalents.

What is claimed is:

1. An earth-boring tool, comprising:

a body including a plurality of blades, each blade of the plurality of blades extending axially and radially relative to a center longitudinal axis of the body;

a plurality of cutting elements secured within the plurality of blades; and at least one protrusion trailing at least one cutting element of the plurality of cutting elements in a direction of intended rotation of the earth-boring tool and extending along a lateral side of a blade of the plurality of blades in which the at least one cutting element is secured, wherein the at least one protrusion extends around an outer lateral side surface of the cutting element to at least substantially a same angular position about a center longitudinal axis of the earth-boring tool as a cutting table of the at least one cutting element.

2. The earth-boring tool of claim 1, wherein an acute angle is defined between the longitudinal axis of the at least one protrusion and a plane to which the center longitudinal axis of the earth-boring tool is normal.

3. The earth-boring tool of claim 1, wherein a gap is defined between a longitudinal end of the protrusion and a diamond table of the at least one cutting element.

4. The earth-boring tool of claim 1, wherein a curvature of an outer lateral surface of the at least one protrusion matches a curvature of an outermost radial edge of the at least one cutting element.

5. The earth-boring tool of claim 1, wherein only a subset of blades of the plurality of blades has the at least one protrusion formed thereon.

6. The earth-boring tool of claim 1, wherein the outer lateral side surface of the at least one protrusion comprises a cylindrical outer surface.

7. The earth-boring tool of claim 1, wherein the at least one cutting element comprises a cutting element secured at a rotationally leading face of a blade of the plurality of blades.

8. The earth-boring tool of claim 1, wherein the at least one cutting element comprises a backup cutting element.

9. The earth-boring tool of claim 1, wherein the at least one cutting element comprises a shadow cutting element.

10. An earth-boring tool, comprising:

a body including a plurality of blades, each blade of the plurality of blades extending axially and radially relative to a center longitudinal axis of the body, at least one blade of the plurality of blades having at least one pocket extending into the at least one blade from a rotationally leading face of the at least one blade in at least a shoulder region of the at least one blade;

a first plurality of cutting elements secured along rotationally leading faces of the plurality of blades; and a second plurality of cutting elements secured to the at least one blade of the plurality of blades proximate a back surface of the at least one pocket; and at least one protrusion trailing at least one cutting element of the second plurality of cutting elements in a direction of intended rotation of the earth-boring tool and extending along a lateral side of the at least one blade of the plurality of blades in which the at least one cutting element is secured, wherein the at least one protrusion extends around an outer lateral side surface of the cutting element to at least substantially a same angular position about the center longitudinal axis of the body as a cutting table of the at least one cutting element.

11. The earth-boring tool of claim 10, wherein the at least one protrusion comprises a longitudinal end comprising an outer lateral surface that transitions to a longitudinal end surface via a rounded surface.

12. The earth-boring tool of claim 11, wherein the rounded surface comprises a radius of curvature within a range of about 0.0635 inch and about 0.50 inch.

13. The earth-boring tool of claim 10, wherein the at least one protrusion comprises a longitudinal end comprising an outer lateral surface that transitions to a longitudinal end surface via a chamfer surface.

14. The earth-boring tool of claim 13, wherein an angle is defined between the chamfer surface and a longitudinal axis of the at least one protrusion, and wherein the angle is within a range of about 5° and about 35°.

15. The earth-boring tool of claim 10, wherein a longitudinal axis of the at least one protrusion is at least substantially collinear with an intended trajectory of the at least one cutting element during a drilling operation.

16. The earth-boring tool of claim 10, further comprising at least one additional protrusion trailing at least one cutting element of the first plurality of cutting elements in a direction of intended rotation of the earth-boring tool and extending along the lateral side of the at least one blade of the plurality of blades in which the at least one cutting element is secured.

17. The earth-boring tool of claim 10, wherein an acute angle is defined between a longitudinal axis of the at least one protrusion and a plane to which the center longitudinal axis of the earth-boring tool is normal.

18. The earth-boring tool of claim 17, wherein the acute angle is within a range of about 5° and about 25°.

19. The earth-boring tool of claim 10, wherein the at least one protrusion is integrally formed with the body of the earth-boring tool.

20. A method of forming an earth-boring tool, comprising:

forming a body of an earth-boring tool including a plurality of blades and at least one protrusion extending across at least a portion of a lateral side of at least one blade of the plurality of blades and having an outer lateral surface having a curvature that at least substantially matches a cutting profile of an associated cutting element;

securing a plurality of cutting elements with the plurality of blades; and securing at least one cutting element proximate the at least one protrusion such that the at least one protrusion trails the at least one cutting element in a direction of intended rotation of the earth-boring tool, the at least one cutting element having the cutting profile, wherein the at least one protrusion extends around an outer lateral side surface of the cutting element to at least substantially a same angular position about a center longitudinal axis of the earth-boring tool as a cutting table of the at least one cutting element.

* * * * *